US005264682A

United States Patent [19]

Copland

[11] Patent Number: 5,264,682

[45] Date of Patent: Nov. 23, 1993

[54] METHOD AND APPARATUS FOR PLOTTING BOAT'S POSITION TO RHUMB LINE WHEN TACKING

[76] Inventor: Donald G. Copland, P.O. Box 361993, Melbourne, Fla. 32936-1993

[21] Appl. No.: 654,727

[22] Filed: Feb. 12, 1991

[51] Int. Cl.[5] ..... G06C 1/00

[52] U.S. Cl. ..... 235/78 N; 235/61 NV

[58] Field of Search ..... 235/77, 78 F, 70 A, 235/83, 87 R, 88 F, 78 N, 88 N, 78 R, 70 R, 70 C, 84, 88 R, , 74, 87 A, 61 NV

[56] References Cited

U.S. PATENT DOCUMENTS 3,876,866 4/1975 Kaspar ..... 235/88

*Primary Examiner*—Russell E. Adams
*Assistant Examiner*—Eddie C. Lee

[57] ABSTRACT

A method and apparatus for plotting a boat's position relative to a rhumb line when tacking. The apparatus includes three independently rotatable disk members. A first disk member presents a compass rose, the second of the disk members presents an indicator that aligns on the compass rose along with a grid, and the third of the disk members presents a rhumb line. The starting and ending positions are plotted on the rhumb line. The rhumb line is then aligned with the compass rose in accordance with the boat's true course. An initial course is set by rotating the indicator with respect to the compass rose on the first disk. The boat's first tack position is located and plotted on the grid by counting grid lines from the starting position. The second disk is then rotated and the next tack position is plotted away from the first tack position. The tack positions are plotted on the third disk to provide the boat's position relative to the rhumb line.

5 Claims, 9 Drawing Sheets

METHOD AND APPARATUS FOR PLOTTING BOAT'S POSITION TO RHUMB LINE WHEN TACKING

BACKGROUND OF THE INVENTION

This invention relates generally to navigational aids. More particularly, the present invention relates to a method and apparatus for plotting a boat's or a yacht's position relative to a rhumb line when the boat tacks.

During boat racing the racing course is typically delineated by three marks that are located at twin points, preferably on an equilateral triangle, which is oriented relative to the direction of the wind for at least the start of the race. Ideally, the race consists of six legs with some of the legs in the direction of the wind, some of the legs downwind and some of the legs at different angles against the wind.

A windward leg is defined as the leg of the course which lies between two marks located in substantial alignment with the wind direction and which requires that the boat sail against the direction of the wind. No boat can sail directly into the wind, because the sails will not fill as necessary to impart a propelling force to the boat. However, at certain angles relative to the wind the sails become quite effective. Although each boat is somewhat different, in general a boat can sail effectively into the wind on a heading of about 45° relative to the eye of the wind. By thus beating to the wind along a successive series of starboard and port tacks, a boat can arrive at a point directly upward of the starting point.

To change from a starboard to a port tack, or vice versa, is called tacking. During the tacking maneuver, the bow of the boat passes through the eye of the wind while the sail changes its position from one side of the boat to the other. As the bow of the boat heads more and more into the wind, the sails begin to luff and lose their ability to drive the boat. If the boat had sufficient speed at the beginning of the maneuver, and if the maneuver is carried out smoothly, the momentum of the boat will swing the bow through the eye of the wind and beyond until the boat is once more headed in the direction that will permit the wind to fill the sails and impart the necessary driving force to the boat.

Continuing with the explanation of the windward leg, it is deemed appropriate to facilitate an understanding of the present invention, the most direct route is directly into the wind is an imaginary line called a rhumb line. This rhumb line represents the direct line between the start of the windward leg and the end point.

As is often the case, when the boat enters the windward leg, the next mark may not be visible from the start of the windward mark. Accordingly, the captain of the boat must use a chart or a map to plot the boat's course. However, when the wind shifts, the captain must constantly recalculate and then re-plot the boat's course.

Without elaborate facilities on-board to plot the course, it is difficult to determine the most advantageous headings to the windward mark, or the time on which the boat must sail on one tack relative to the other tack. These difficulties are compounded as previously described when one is unable to see the windward mark from the location where the race was started.

Various racing calculators have been constructed to try to alleviate some of the problems previously discussed. Examples of these calculators are disclosed in U.S. Pat. Nos. 4,689,476 and 4,855,577. However, these calculators only determine numbers such as time, distance or headings in which the boat is to travel, but do not show a relative position of the boat with respect to the rhumb line. Further, these calculators may be bulky or cumbersome to use when actually racing.

SUMMARY OF THE INVENTION

An object of this invention is to provide an improved method and apparatus for plotting the boat's position relative to a rhumb line when tacking.

Another object of this invention is to determine the relative distance spent on each tack relative to a rhumb line to more accurately position the boat close to the windward mark.

It is also an object of this invention to more efficiently determine the headings with a calculator by which the boat can sail relative to the windward leg.

An additional object of this invention is to manually operate a calculator to show the boat's relative position with respect to a rhumb line.

Another object of this invention is to operate a navigational calculator with a plurality of disks that may be manually operable to determine the distance between the boat and the rhumb line, the course direction, the appropriate compass headings for port and starboard tacks and the time spent, or distance to be sailed on each tack.

It is an additional object of the present invention to manually operate a navigational calculator that determines the most efficient locations at which the boat should tack.

These and other objects are accomplished with an apparatus for plotting a boat's position and heading relative to a rhumb line when tacking. The apparatus comprises a plurality of disk members and means for permitting the disk members to be rotated independently of each other. The first of these disk members presents a compass rose and the second of the disk members presents a direction of travel indication and plurality of grid lines. At least one of the grid lines is parallel to the indicator and at least one of the plurality of grid lines is perpendicular to the direction of travel indicator. The distance between the grid lines corresponds to the relative distance sailed on respective starboard and port tacks, effectively to traverse a course designated by the rhumb line indicator. The third of the disk members presents a rhumb line indicator designating a course direction. The second disk member is rotatable with respect to the first disk member to selectively align the direction of travel indicator with respect to the boat's heading as represented on the compass, while maintaining proper alignment by the third disk member with the compass rose. Thus, the course of the boat may be plotted on the third disk such that the position of the rhumb line relative to the course is visible.

The above objects may also be accomplished by the method of plotting a boat's position relative to a rhumb line, the method being accomplished by manipulating a plurality of disks and comprising the steps of aligning a rhumb line indicative of a true course direction presented on a first side of the disk with the indication of a compass rose presented on a second of the disks, and locating a starting point corresponding to the boat's starting location on the first disk. A third disk is provided with a boat direction indication pointer, a plurality of grid lines parallel to the direction the boat indicator points and a plurality of grid lines perpendicular to the direction the boat indicator points. The directional indication pointer presented on the disk with the compass rose is aligned on the second disk in accordance with a first direction of travel of the boat. A first intermediate point on the first disk corresponds to the boat's first intermediate location is located by counting grid lines away from the start point corresponding to the distance to be traveled by the boat from the starting location. The third disk is rotated to align the boat directional indicator with the compass rose in accordance with the second direction of travel of the boat. A second intermediate point is located on the first disk after rotating the third disk in accordance with the second direction of travel by counting grid lines away from the first intermediate point corresponding to the distance to be traveled by the boat from the first intermediate location. In this way, the boat's position may be plotted relative to the rhumb line throughout the boat's travel.

DESCRIPTION OF THE PREFERRED EMBODIMENTS

Figure 1:
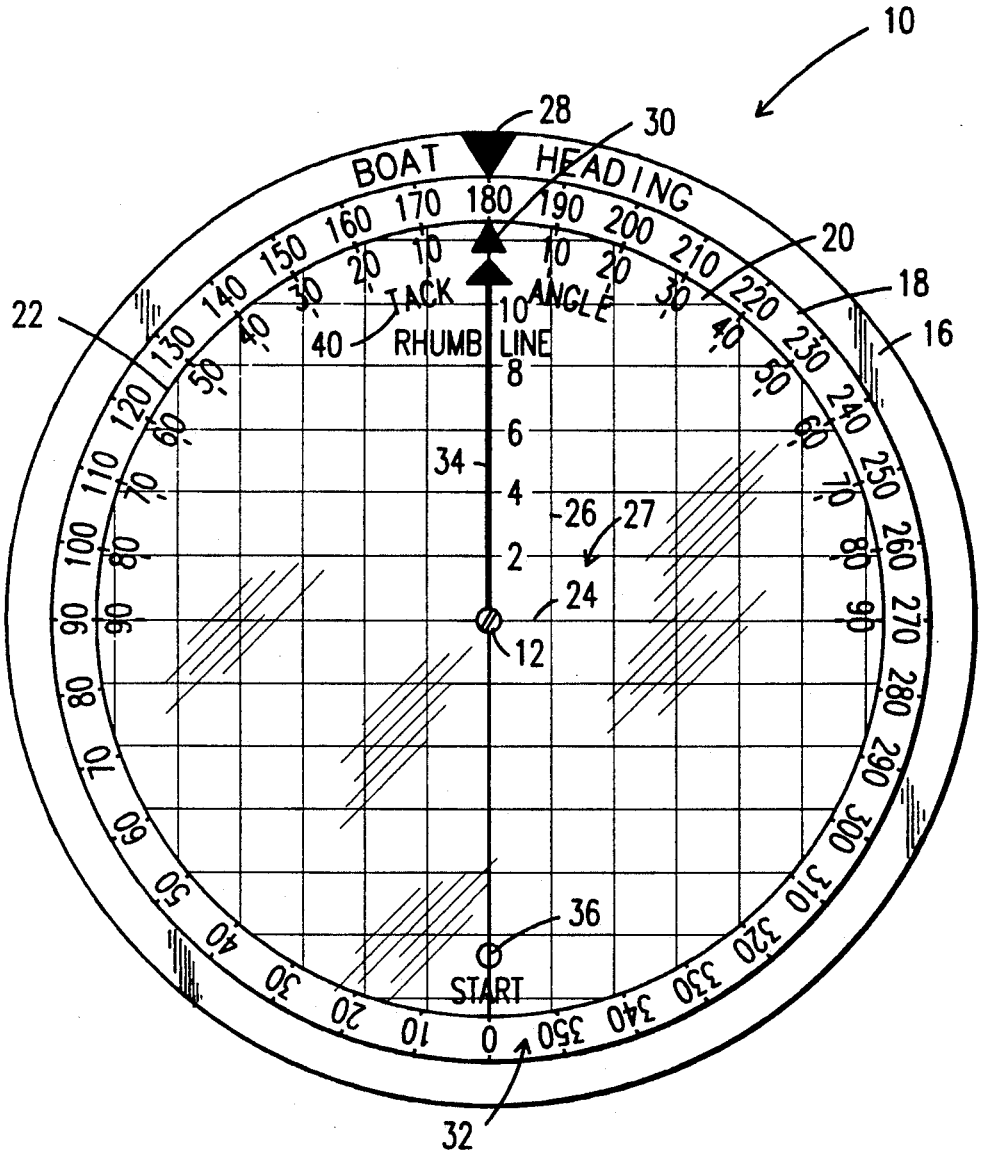
FIG. 1 is a top view of the apparatus used for plotting the boat's position embodying the concepts of the present invention.

Referring to FIG. 1, an apparatus for plotting a boat's or a yacht's position relative to a rhumb line is designated generally by the number 10 on the accompanying drawings. The apparatus 10 includes a central support 12 having a flange (not shown) disposed on the opposite end of central support 12. Three disk members 16, 18 and 20 are mounted on central support 12.

Disk members 16, 18 and 20 are preferably fixedly secured to central support 12 in a manner not detected, but the disk members 16, 18 and 20 are independently rotatably mounted about central support 12. It is preferable that disk members 18 and 20, though rotatably positioned will tend to maintain their position in respect to each other when disk member 16 is rotated. If desired, frictional material may be placed between disk members 18 and 20. This friction means serves to enhance disk members 18 and 20 to remain relatively fixed when disk member 16 is rotated. However, disk members 18 and 20 must be rotatable about central support 12 relative to each other and disk member 16, although with some modest manual effort.

Figure 2:
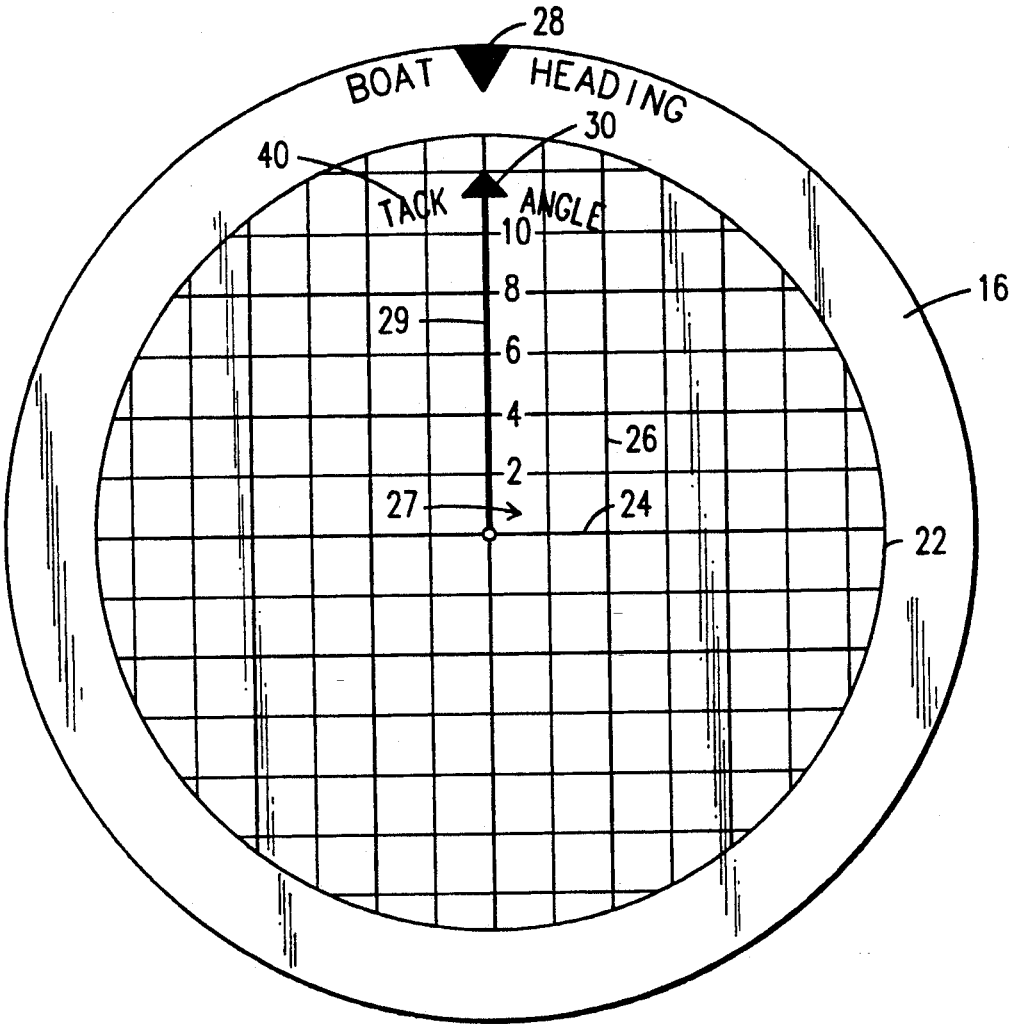
FIG. 2 is a top view of the bottom disk shown in FIG. 1.

Referring to FIGS. 1 and 2, disk member 16 is preferably circular with a marker and an indicia of boat heading adjacent the outside perimeter of disk member 16. Spaced a small distance apart from the perimeter of disk member 16 is an inner circle 22. Within inner circle 22 is a plurality of horizontal grid lines 24 and vertical grid lines 26 forming a plurality of grids 27, the vertical grid lines 26 are aligned with vertical heading marker 28, and the horizontal grid lines 24 are normal to said vertical grid lines 26. Disposed on a center vertical grid line 26 within inner circle 22 is tack angle marker 30 and tack angle indicia 40. Disk member 16 contains drift line 29 with numbers 2, 4, 6, 8 and 10. Drift line 29 is used for adjusting the angle of rhumb line 34 to compensate for drift currents. These words and marks on disk member 16 are preferably imprinted. The imprinting on this disk, as well as the imprinting hereafter mentioned on disk members 18 and 20, can be accomplished by any conventional means of printing or embossing.

Figure 3:
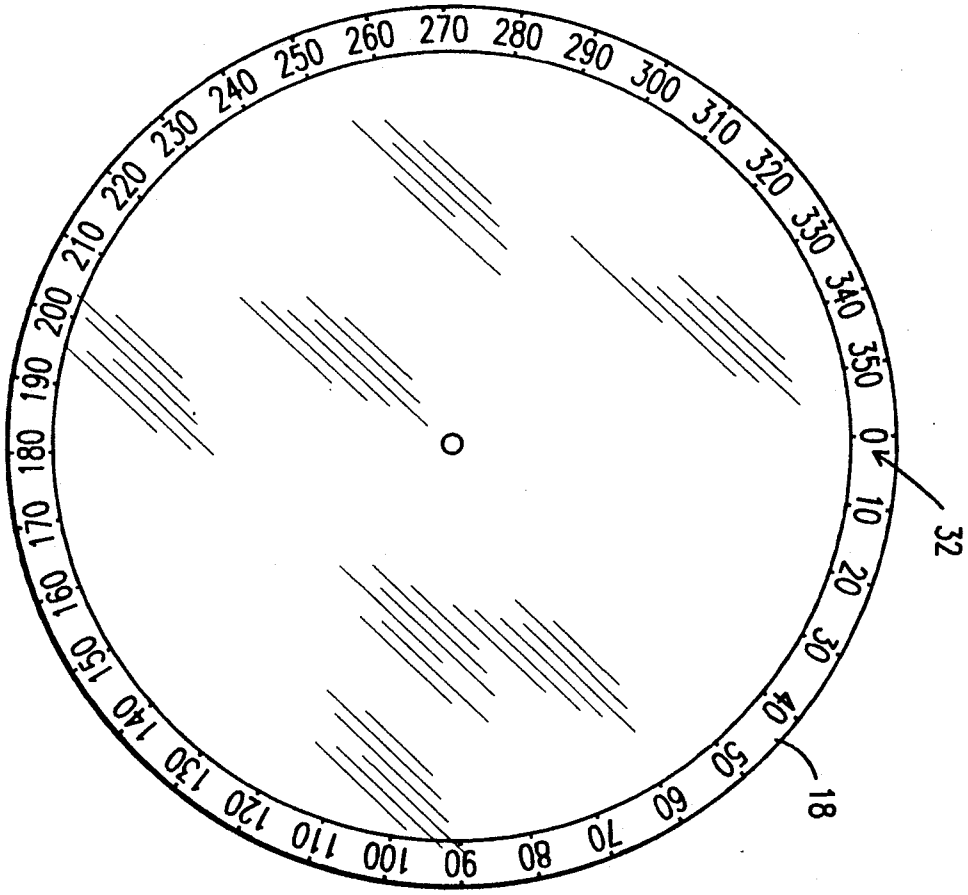
FIG. 3 is a top view of the middle disk shown in FIG. 1.

Referring to FIGS. 1 and 3 there is shown disk member 18, preferably circular having a compass rose 32 printed thereon. The divisions of the compass rose 32 are set forth in 10° increments. Although the enclosed figures are shown with 10° increments, it is preferable that compass rose 32 be inscribed in 1° increments. Those familiar with a compass rose know that the angular extent of the compass rose is 360°. The position designated with the "0" represents both 0° and the 360° positions.

This disk member 18 preferably is of lesser diameter than disk member 16 so that indicia on disk member 18 can be seen when apparatus 10 is held in the hands and disposed in the orientation as depicted in FIG. 1, and FIGS. 6 through 9. Disk member 18 is preferably transparent along a perimeter area interior to the compass rose 32 indicia. As previously explained, the disk member 16 can be selectively rotated about central support 12. As such the compass rose 32 on disk member 18 can be rotated to align the boat heading and tack angle with any point on compass rose 32.

Figure 4:
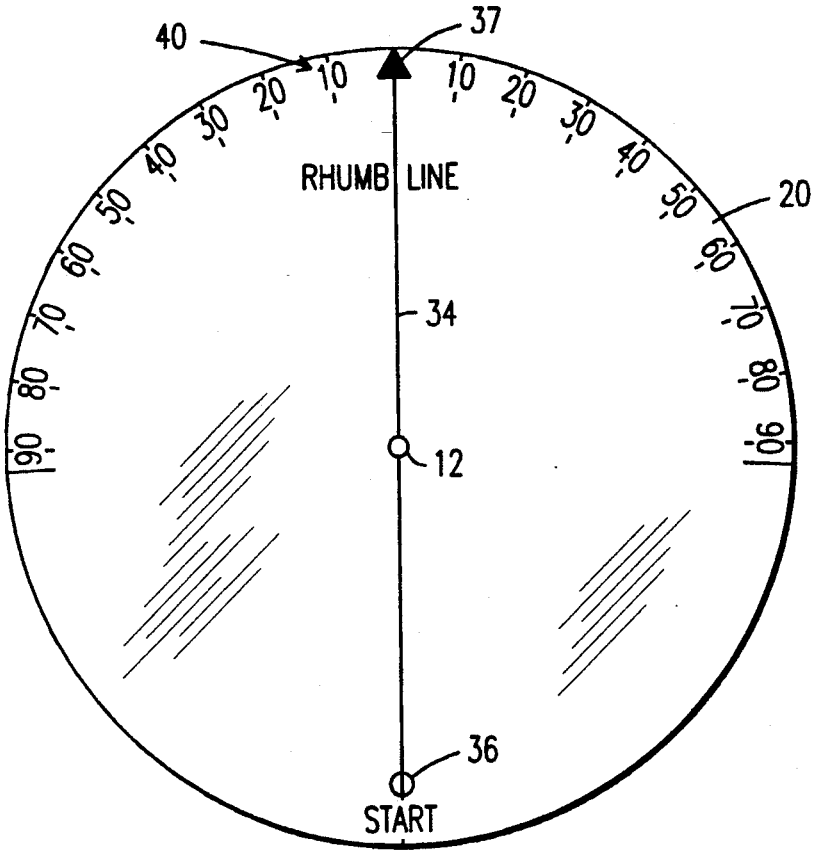
FIG. 4 is a top view of the top disk shown in FIG. 1.

Referring to FIG. 4 there is shown disk member 20, also preferably circular, having a rhumb line 34 extending from the outside perimeter of disk member 20 through central support 12 to the other side of disk member 20. Disposed on rhumb line 34 at one end is a start point 36 indicating start position of the boat and an arrow 37 that aligns with compass rose 32 on disk member 18 to indicate the direction of rhumb line 34. Printed on disk member 20 are tack angles indicia 40. These tack angles indicia 40 are set forth in 10° increments ranging from 10° to 90° on each side of rhumb line 34. Although the enclosed figures are shown with 10° increments, it is preferable that tack angle indicia 40 be inscribed in 1° increments.

Disk member 20 on its interior relative to tack angle indicia 40 is transparent such that when disk member 20 is mounted over disk members 18 and 16, and horizontal grid lines 24 and vertical grid lines 26 are visible. Disk member 20 is also preferably coated with, or made from a material, that will allow transparency markers to write onto disk member 20, and be erased from disk member 20 without leaving a permanent mark.

Figure 5:
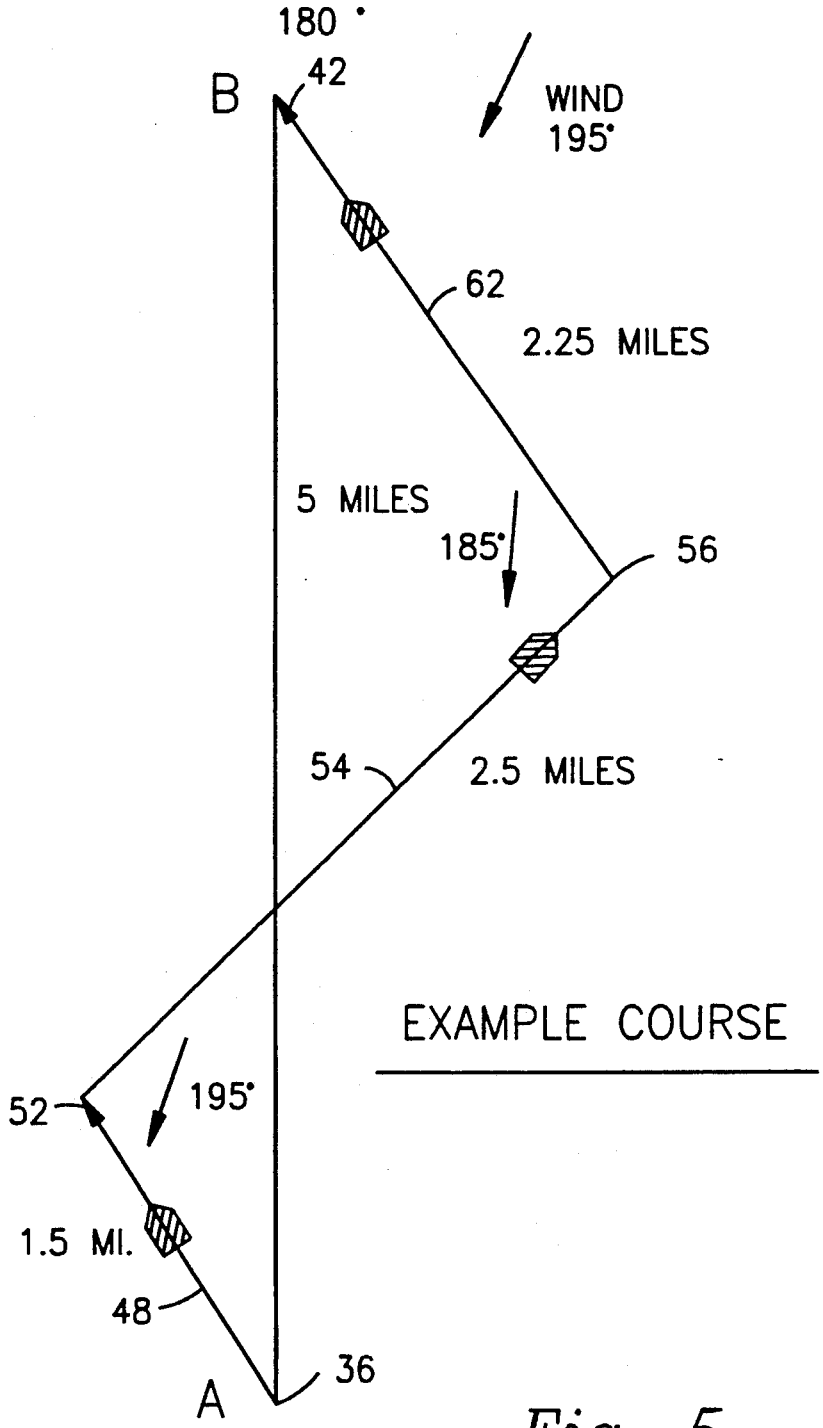
FIG. 5 is a diagram showing exemplary windward leg sailed between marks "A" and "B"

Referring to FIG. 5 there is shown an exemplary windward leg of a course extending between marks "A" and "B." This course is shown for illustrative purposes explaining the operation of apparatus 10. Details of the apparatus 10 operation will be explained in reference to this description while referring to FIGS. 6 through 9.

The exemplary course shown in FIG. 5 is for a boat traveling from mark "A" to mark "B" where mark "B" is 180° compass setting south of mark "A." Further, the distance between mark "A" and mark "B" is set to be five miles. Mark "A" for the purpose of illustration corresponds to the starting point, and Mark "B" corresponds to the ending point.

Figure 6:
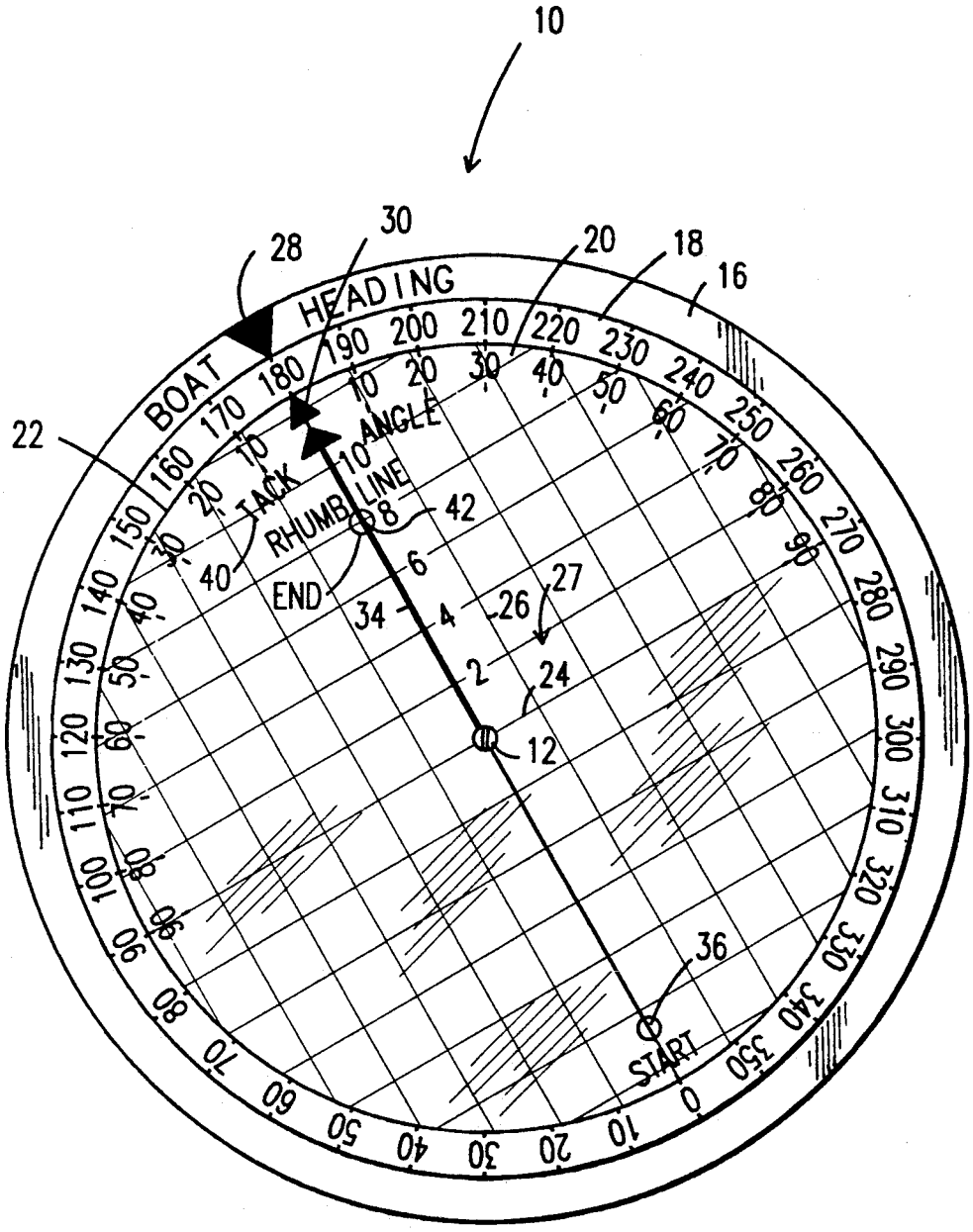
FIG. 6 is a top view of apparatus shown in FIG. 1 with the starting position and ending position plotted in accordance with the exemplary windward leg shown in FIG. 5.

Referring to FIG. 6, the first step in setting up apparatus 10 is aligning disk members 16, 18 and 20 such that heading marker 28 and arrow 37 align on the 180° setting on compass rose 32. Then the distance between adjacent horizontal grid lines 24 or vertical grid lines 26 is assigned an arbitrary boat travel distance, i.e., ½ mile. Next, horizontal grid lines 24 are counted upward along rhumb line 34 from start point 36 by a number corresponding to the distance the boat is traveling. For example, using ½ mile as the distance between adjacent horizontal grid lines 26 and five miles as the distance to be traveled, ten horizontal grid lines 24 are counted along rhumb line 34 from start point 36 in the direction of arrow 37. An end point 42 is then plotted on disk member 20 with a transparency marker. Although a half-mile is designated during the following example as the distance between either adjacent horizontal grid lines 24 or adjacent vertical grid lines 26, this distance can easily be changed to one mile, two miles, or three miles, etc.

Referring to FIG. 5 the next step in the operation of apparatus 10 is to determine the direction of the first leg 48 of the boat's course. Prior to starting the first leg, the following information is obtained:

a. the wind direction;
b. the course direction—ie, the compass heading to the windward mark; and
c. the estimated or known boat speed over the bottom while sailing to the windward.

The following values have been arbitrarily assumed and provided merely for the purposes of facilitating the operation and explanation which follows:

a. The wind direction is initially set to 195° magnetic, but at the first tack it changes to 185° magnetic, and after second tack it changes to 195° magnetic;
b. The boat speed is five miles per hour; and
c. The distance between marks "A" and "B" is five miles.

It is assumed that the included tacking angle is approximately 90°. It is also assumed that the boat can travel into the wind at 45° angles.

Figure 7:
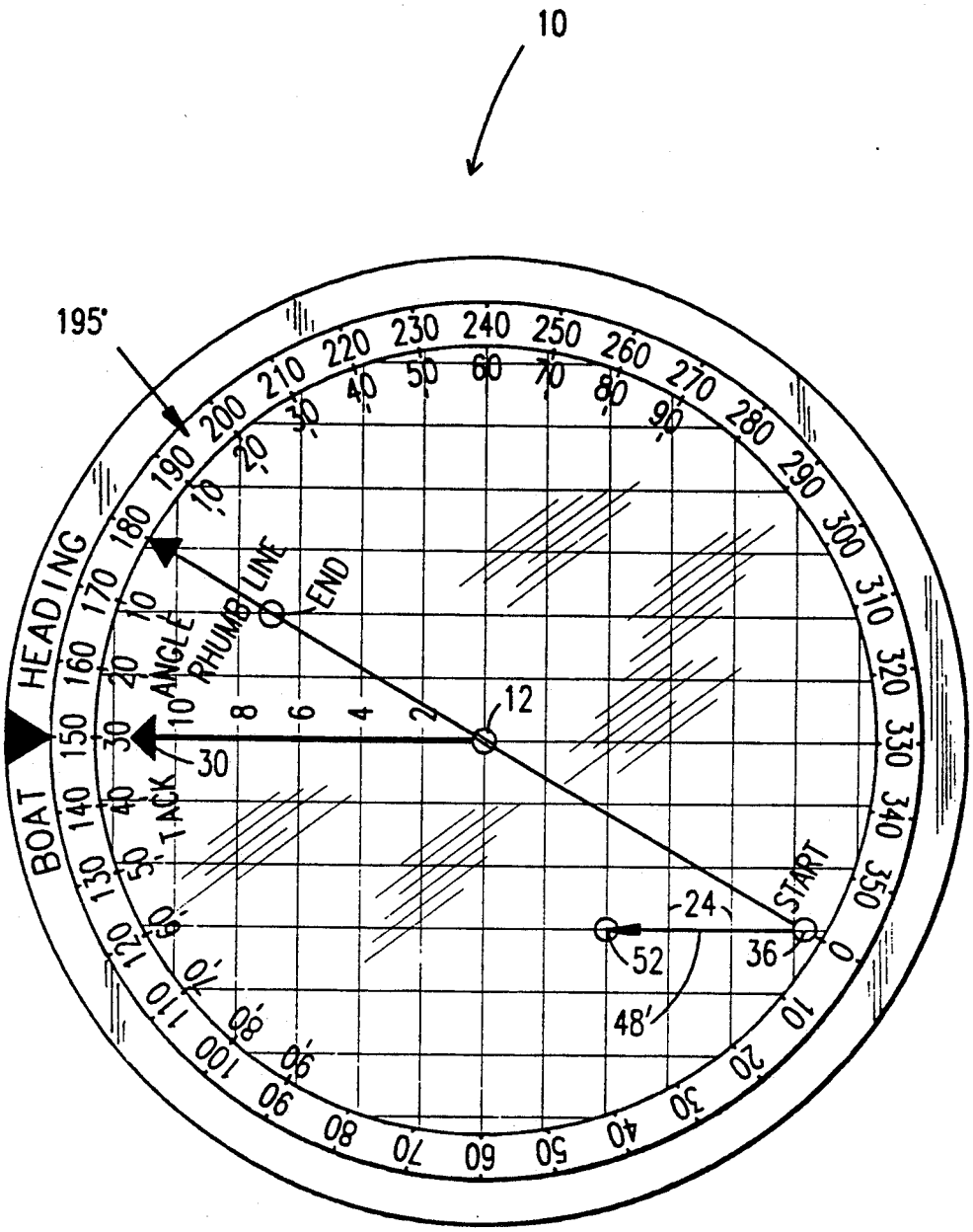
FIG. 7 is a top view of the apparatus shown in FIG. 6 with the first leg of the windward leg shown in FIG. 5 plotted.

When traveling the first leg 48 of the windward leg, the boat heading must be established. Referring to FIG. 7 the boat heading is set by subtracting the maximum angle (45° ) at which the boat can sail into the wind from the (195° ) wind direction. This establishes a boat heading of 150°. Accordingly, the tack heading marker 28 on disk member 16 is aligned with 150° on the compass rose 32, while maintaining arrow 37 at the 180° indicia on the compass rose 32. During this example, rhumb line 34, as well as arrow 37, remains aligned to compass rose heading 180°.

Thus, a first tacking point 52 is then plotted on disk member 20 corresponding to a distance of 1.5 miles along first leg 48 (FIG. 5) from start point 36. Although for the purpose of illustration the first tacking point 52 is located at a distance of 1.5 miles from the starting point, this tacking point 52 can be plotted anywhere along first leg 48. The first tacking point 52 is set by counting three (half mile) grid lines 24 from start point 36 along grid line 26. A first leg 48' is then drawn to connect start point 36 to first tacking point 52. At the exemplary boat speed of five miles per hour the boat will reach first tacking point 52 in approximately 18 minutes.

Figure 8:
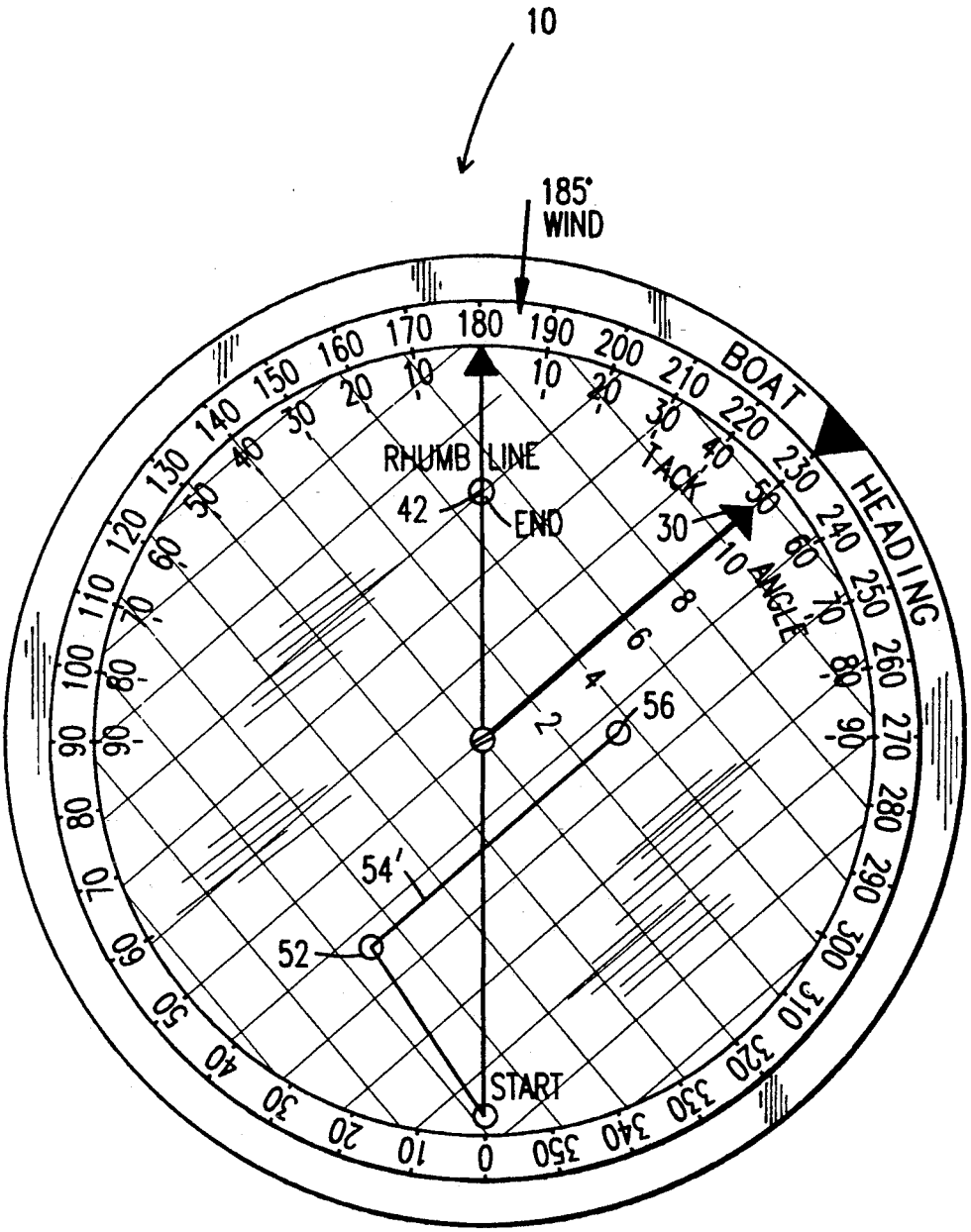
FIG. 8 is a top view of the apparatus shown in FIG. 7 with the second leg of the windward leg shown in FIG. 5 plotted.

When this boat reaches first tacking point 52, a second tacking leg 54' is plotted on disk member 20 corresponding to line second tacking leg 54 in FIG. 5. Referring to FIG. 8, the second tacking leg 54' is plotted by first determining the wind direction, in this case 185°, and then adding 45° to the wind direction to determine a boat heading. If the wind direction happened to be at another direction when tacking is about to occur, 45° would be added (or subtracted) from the direction to determine the second tacking leg 54'. Second, the boat heading marker 28 on disk member 16 is turned to align with the 230° heading on compass rose 32. A second tacking point 56 is then plotted on disk member 20 by counting the number of horizontal grid lines 24 using the method described previously. In this instance the boat will travel a hypothetical 2.5 miles along tacking leg 54 (FIG. 5). Thus, the second tacking point 56 is plotted at five grid lines from first tacking point 52 in the direction of heading marker 28. Tacking leg 54' is drawn on disk member 18 by drawing second tacking leg 54' to connecting tacking point 56. Using a five mile per hour boat speed, the boat will travel for 30 minutes before reaching tacking point 56.

Figure 9:
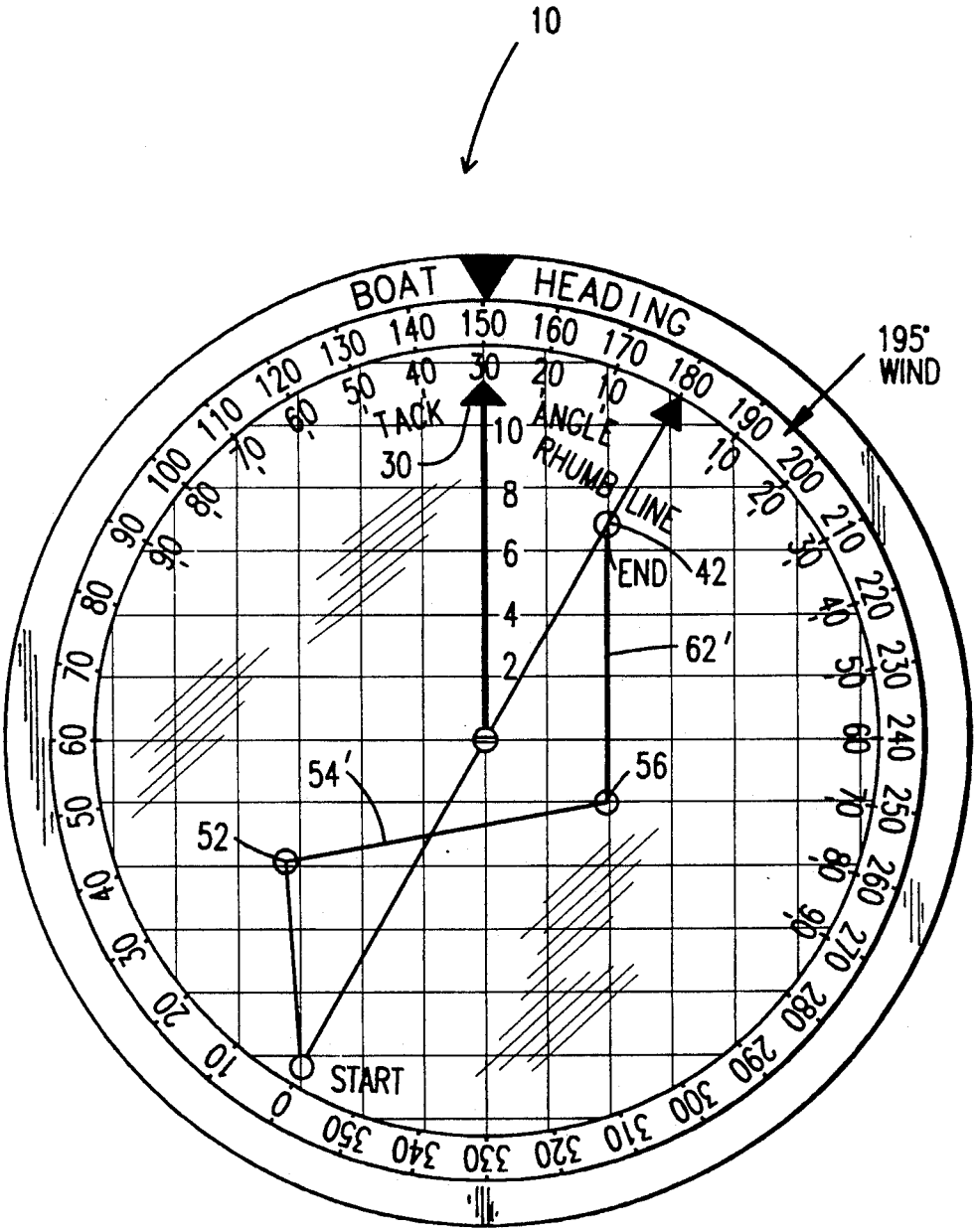
FIG. 9 is a top view of the apparatus shown in FIG. 8 with the final leg of the windward leg shown in FIG. 5 plotted.

Referring to FIG. 5. Once the boat reaches tacking point 56, the boat will tack toward mark "B" (end point 42). This final leg 62 is established by first determining the wind direction at the tack location, in this case 195°. Second, the maximum angle that the boat can sail into the wind (45°) is subtracted from the wind direction (195°) to obtain the boat's heading (150°). Referring to FIG. 9, disk member 16 is then rotated such that heading marker 28 lines up with the 150° setting on compass rose 32. The final leg 62' is plotted on disk member 20. The number of grids from second tacking point 56 to end point 42 is counted to determine the distance to Mark "B" (end point 42). In this instance the final distance is approximately 2.5 miles. The boat would require 30 minutes to complete this distance at five miles per hour.

The boat's course, from start point 36 (Mark "A") to end point 42 (Mark "B"), is shown plotted on disk member 20. If it is necessary to extend the course, the plotted course could be erased, and the steps previously described may be repeated by locating the end point 42 at the start point 36 location.

The calculator may also be set to compensate for cross/drift currents when the initial rhumb line is set. This compensation is done by determining the drift of the yacht or the boat at the end of the course. The drift line 29 is then turned to be 90° to the rhumb line when the initial rhumb line is set. Next, the rhumb line angle is adjusted to an effective rhumb line by adjusting the angle of arrow 37 on rhumb line 34 so as to line up with the horizontal grid line 24 that intersects the number on drift line 29 corresponding to the drift distance at the enc of the course. Thus, the required rhumb line is maintained.

It may also be preferable that a time/distance/speed calculator as are commonly known be mounted on the other side of disk 16 then disks 18 and 20.

This concludes the description of the preferred embodiments. A reading by those skilled in the art will bring to mind various changes without departing from the spirit and scope of the invention. It is intended, however, that the invention only be limited by the following appended claims.

What is claimed is:

1. A method of plotting a boat's position relative to a rhumb line, the method being accomplished by manipulating a plurality of disks, the method comprising the steps of:

aligning a rhumb line indicative of a true course direction presented on a first of said disks with an indication of a compass rose presented on a second of said disks;

locating a start point on said first of said disks corresponding to a starting location of the boat;

providing a third disk with a boat direction indicator pointer, a plurality of grid lines parallel to a direction said direction indicator points and a plurality of grid lines perpendicular to the direction said boat indicator points;

aligning the directional indication pointer presented on the first of said disks with the compass rose on a second of said disks in accordance with a first direction of travel of the boat;

locating a first intermediate point on said first of said disks that corresponds to a boat's first intermediate location by counting grid lines away from said start point corresponding to a distance of travel of the boat from the starting location;

rotating the third of said disks to align the boat direction indicator with the compass rose in accordance with a second direction of travel of the boat; and locating a second intermediate point on said first of said disks after rotating the third disk in accordance with the second direction of travel by counting grid lines away from said first intermediate point corresponding to a second distance of travel of the boat from the first intermediate location.

2. The method as recited in claim 1 further comprising the step of drawing a line on one of said disks to connect the start point with the intermediate point.

3. The method as recited in claim 2 further comprising the step of drawing a plot on one of said disks to connect the first intermediate point with the second intermediate point.

4. The method as recited in claim 1 further comprising the step of positioning the first of the disks on top of the plurality of disks.

5. The method as recited in claim 4 further comprising the step of positioning the third of the disks on the bottom of the plurality of disks.

* * * * *